US010888729B2

(12) United States Patent
Haines et al.

(10) Patent No.: US 10,888,729 B2
(45) Date of Patent: Jan. 12, 2021

(54) AGILITY ENHANCEMENT APPARATUS

(71) Applicants: Thomas Earl Haines, Elizabeth, CO (US); Ronald Leslie Ferguson, Elizabeth, CO (US)

(72) Inventors: Thomas Earl Haines, Elizabeth, CO (US); Ronald Leslie Ferguson, Elizabeth, CO (US)

( * ) Notice: Subject to any disclaimer, the term of this patent is extended or adjusted under 35 U.S.C. 154(b) by 91 days.

(21) Appl. No.: 16/141,873

(22) Filed: Sep. 25, 2018

(65) Prior Publication Data

US 2019/0099635 A1 Apr. 4, 2019

Related U.S. Application Data

(60) Provisional application No. 62/566,976, filed on Oct. 2, 2017.

(51) Int. Cl.
*A63B 21/06* (2006.01)
*A63B 21/00* (2006.01)
(Continued)

(52) U.S. Cl.
CPC ..... *A63B 21/0601* (2013.01); *A63B 21/0004* (2013.01); *A63B 21/0608* (2013.01);
(Continued)

(58) Field of Classification Search
CPC .. A63B 5/20; A63B 5/22; A63B 15/00; A63B 15/005; A63B 21/0004; A63B 21/00043; A63B 21/00058; A63B 21/00061; A63B 21/00065; A63B 21/00069; A63B 21/00072; A63B 21/00076; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/0601;
(Continued)

(56) References Cited

U.S. PATENT DOCUMENTS 3,428,325 A * 2/1969 Atkinson ..... A63B 15/00 473/256
3,653,660 A * 4/1972 Malhas ..... A63B 47/00 473/464
(Continued)

*Primary Examiner* — Gary D Urbiel Goldner
(74) *Attorney, Agent, or Firm* — Roger A. Jackson

(57) ABSTRACT

An agility enhancement apparatus and method of use for an individual to engage in manual agility enhancement activity, the agility enhancement apparatus includes a beam having a proximal end portion and an opposing distal end portion with a longitudinal axis spanning therebetween. Further included in the agility enhancement apparatus is a weight affixed to the distal end portion, wherein the weight makes the distal end portion weigh more than the proximal end portion. Also included in the agility enhancement apparatus is a flexible tether extension having a first end portion and an opposing second end portion with a longwise axis spanning therebetween. The flexible tether extension first end portion is affixed to the proximal end portion wherein the flexible tether second end portion is a free cantilever end, wherein operationally the individual grasps the tether second end portion and swings the beam in a free movement pattern.

15 Claims, 14 Drawing Sheets

(51) Int. Cl.
*A63B 23/035* (2006.01)
*A63B 71/00* (2006.01)
*A63B 21/075* (2006.01)

(52) U.S. Cl.
CPC ..... *A63B 21/4035* (2015.10); *A63B 21/4043* (2015.10); *A63B 23/03516* (2013.01); *A63B 23/03525* (2013.01); *A63B 71/0054* (2013.01); *A63B 21/075* (2013.01); *A63B 2071/0072* (2013.01)

(58) Field of Classification Search
CPC . A63B 21/0608; A63B 21/068; A63B 21/072; A63B 21/075; A63B 21/08; A63B 21/15; A63B 21/151; A63B 21/159; A63B 21/4023; A63B 21/4027; A63B 21/4033; A63B 21/4035; A63B 21/4043; A63B 23/035; A63B 23/03516; A63B 23/03525; A63B 23/12; A63B 23/1209; A63B 23/1245; A63B 23/1281; A63B 65/04; A63B 71/0054; A63B 2071/0072; A63B 2244/17
See application file for complete search history.

(56) References Cited

U.S. PATENT DOCUMENTS 4,026,549 A * 5/1977 Gunn ..... A63B 21/0004 482/124
4,801,137 A * 1/1989 Douglass ..... A63B 5/20 482/108
5,087,220 A * 2/1992 Cotita ..... A01K 15/02 119/719
D334,605 S * 4/1993 Forgione ..... D21/672
5,213,557 A * 5/1993 Firth ..... A63B 23/20 482/105
5,405,138 A * 4/1995 Duran ..... A63B 69/3635 473/234
5,577,966 A * 11/1996 Duran ..... A63B 69/3635 473/234
5,662,561 A * 9/1997 McNamara ..... A63B 5/20 482/82
5,865,686 A * 2/1999 MacGregor ..... A63B 15/00 473/228
6,068,581 A * 5/2000 Anderson ..... A63B 23/20 482/105
D428,461 S * 7/2000 Koszalinski ..... D21/791
6,544,148 B1 * 4/2003 Loew ..... A63B 5/20 482/82
D477,853 S * 7/2003 Davies ..... D21/672
6,595,827 B2 * 7/2003 Kirley ..... A63H 1/06 273/330
6,752,747 B2 * 6/2004 Yu ..... A63B 21/00043 482/110
6,887,188 B1 * 5/2005 Davies ..... A63B 5/20 446/247
7,828,703 B1 * 11/2010 Boesch ..... A63B 21/0602 482/112
7,828,704 B1 * 11/2010 Hsieh ..... A63B 21/0004 482/121
8,172,696 B2 * 5/2012 Lum ..... A63B 69/3623 473/256
8,192,335 B2 * 6/2012 Pullaro ..... A63B 15/00 482/109
8,262,544 B1 * 9/2012 Blackford ..... A63B 21/06 482/105
8,540,584 B1 * 9/2013 Sorenson ..... A63B 69/36 473/256
8,888,666 B2 * 11/2014 Quader ..... A63B 21/0004 482/109
D741,433 S * 10/2015 Auld ..... D21/799.1
9,387,382 B2 * 7/2016 Long ..... A63B 69/0002
9,687,718 B1 * 6/2017 Sorenson ..... A63B 69/385
9,757,604 B2 * 9/2017 Carter ..... A63B 21/1645
10,150,001 B1 * 12/2018 Blackford ..... A63B 21/062
2002/0091010 A1 * 7/2002 Tanimoto ..... A63B 69/3623 473/256
2004/0038783 A1 * 2/2004 Hunter ..... A63B 23/20 482/105
2009/0203471 A1 * 8/2009 Roudybush ..... A63B 69/0002 473/424
2010/0093502 A1 * 4/2010 Marji ..... A63B 5/20 482/82
2011/0237360 A1 * 9/2011 Dodson ..... A63B 69/385 473/463
2011/0237361 A1 * 9/2011 Dodson ..... A63B 15/005 473/463
2012/0202611 A1 * 8/2012 Warren ..... A63B 69/0002 473/229
2012/0316012 A1 * 12/2012 Thackeray ..... A63B 15/00 473/457
2013/0190145 A1 * 7/2013 Kugielsky ..... A63B 21/00196 482/110
2013/0267394 A1 * 10/2013 Duke ..... A63B 21/026 482/110
2013/0274074 A1 * 10/2013 Ghandour ..... A63B 21/16 482/93
2014/0329650 A1 * 11/2014 Watry ..... A63B 21/4035 482/139
2015/0005090 A1 * 1/2015 Parker ..... A63B 15/00 473/226
2015/0119172 A1 * 4/2015 Long ..... A63B 69/0002 473/457
2015/0335931 A1 * 11/2015 Jordan ..... A63B 5/20 482/82
2017/0036085 A1 * 2/2017 Suzuki ..... A63B 59/70

* cited by examiner

AGILITY ENHANCEMENT APPARATUS

RELATED PATENT APPLICATION

This application claims the benefit of U.S. provisional patent application Ser. No. 62/566,976 filed on Oct. 2, 2017 by Thomas Earl Haines of Elizabeth, Colo., U.S. and Ronald Leslie Ferguson of Elizabeth, Colo., U.S.

TECHNICAL FIELD

The present invention is directed to an apparatus that enhances a user's agility in periodically manually conducting a pendulum type motion with a dynamic object that is tethered to a pair of manual handholds that the user grasps. More particularly, the present invention is a tethered weight that is affixed a pair of flexible tethers that are each grasped in each user's hand, wherein the user utilizes somewhat of a figure eight motion of their hands to swing the tethered variable weight in accordance with the user's hand motion. The tethered weight motion or movement can have varying cycle frequency and amplitude from the manual nature of the varying repetitive speed and varying force that the user can impart to the tethered weight and the changing positions of the user's torso position, thus changing up the agility skill required resulting in desired muscle confusion as opposed to a steady rhythmic hand/arm/torso frequency and amplitude.

BACKGROUND OF INVENTION

It is well recognized in the prior art the benefit of rhythmically manually engaging in agility enhancement, especially common in the fields of boxing and self-defense. However, if the rhythm becomes too steady over time, related to the frequency and amplitude of the tethered weight being consistent or nearly consistent, the agility benefit to the user becomes greatly reduced and the user's muscles become trained in a routine and do not improve their flexibility or agility. There is a movement afoot today that is termed "muscle confusion" that has shown that changing up one's agility enhancement routine results in better muscle tone and conditioning, such as in jogging—wherein a person would jog for so many miles at a steady pace-would achieve a minimal benefit, this as opposed to engaging in muscle confusion, which would have the jogger sprinting, walking, and jogging in a random way, this keeping the muscles in a dynamic state of (velocity & load) change (enhanced conditioning benefit) as opposed to a steady routine (minimal conditioning benefit).

Thus, this is the goal of the present invention in helping to create muscle confusion, due to the variable frequency and amplitude manually imparted to the tethered weight via the user's hands and the user's torso and leg movement, thus making the tethered weight movement path desirably unpredictable.

In the portable agility enhancement apparatus prior art in U.S. Patent No. 6,752,747 to Yu disclosed is a multi-directional swivel body builder, mainly comprising a moveable bent shank, two handles, two retaining springs and two end wheels, each end of said bent shank linking with a coil spring, a protection jacket covering said bent shank and said coil springs, characterized in that: a joint tube has a lock hole and a ring groove for receiving the retaining spring. The retaining spring in Yu has a turnover leave with a lock post fitting into the lock hole of the joint tube, the joint tube slides into a sleeve tube of the handle, the sleeve tube has a plurality of adjustable holes, after the joint tube slides in place in the sleeve tube, the lock post of the retaining spring will fit into one of the adjustable holes and a catch lug on an inner wall of the sleeve tube will enter the ring groove of the joint tube to disengage the lock post of the retaining spring. Thus permitting in Yu the handle to adjust and gain a proper bent angle, then the lock post fits into the proper adjustable hole and holds the angled handles that is accomplished with the adjustment; and the handle end connects to a lock shaft and an end wheel, when the end wheel is swayed, the bent shank begins self-rotation.

Continuing in the portable agility enhancement apparatus prior art in U.S. Pat. No. 7,828,704 to Hsieh, et al. disclosed is a combination limb and abdominal agility enhancement, comprising: a set of pivotally connected rod members including first and second main bodies which can be assembled and fixed to each other, each of the first and second main bodies having an extending rod, the two rods being able to be moved outward away from or moved inward closer to each other, and a handle being disposed at the end of each of the rods. Wherein in Hsieh, each of the first and second main bodies has a through hole and a groove disposed on the periphery of the through hole, and a post passes through the two through holes which are respectively covered by covers which are respectively fixed to the first and second main bodies by means of locking portions; two handles, each of which is pivotally disposed at an end thereof to the end of each of the two rods, so that the handles, when subjected to an external force, rotate at an angle about a longitudinal axis of the extending rod.

Further in Hsieh, a second torsional spring is disposed between each handle and the corresponding rod to bias against the rotation of the handles; and a first torsional spring, which is mounted around the post and disposed between the two rods of the set of pivotally connected rod members so as to normally maintain a fixed included angle between the two rods and provide an agility enhancement resistance when the two rods are moved outward away from or moved inward closer to each other by an external force. Wherein in Hsieh the end of each of the two rods is formed with a sub-rod, and the second torsional spring is mounted around the sub-rod on which a locking cap is securely mounted above the second torsional spring, wherein a locking hole is disposed on the sub-rod for the fixation of the locking cap, and wherein one end of the second torsional spring enters a first through hole preset on the rod, and the other end of the second torsional spring enters a second through hole preset on the handle.

Next in the portable agility enhancement apparatus art in U.S. Pat. No. 8,888,666 to Quader disclosed is a strength training apparatus comprising: an elastic headpiece constructed to recoil in response to being struck against a rigid surface; a handle mechanically coupled to the headpiece such that the recoil of the headpiece is transferred to the handle; and a centripetal stop at the distal end of the handle and disposed interior to the headpiece so as to couple the handle thereto and retain the headpiece thereon.

Moving onward in the portable agility enhancement apparatus prior art in U.S. Pat. No. 6,595,827 to Kirley, disclosed is a swinging toy intended for the purpose of recreation, physical and mental health, agility, and leisure purposes. Kirley includes a padded object and a cord with a hand or finger loop, wherein the object includes a central cavity that may selectively or permanently contain a substance. The substance in Kirley may include colored water, beads which may glow in the dark, chemiluminescent fluid, batteries together with a light, reflective material, e.g, tin foil, chemical compositions that alternate between colors or other such substances, or magnetically powered light sources. Further in Kirley, a decorative tail may be attached to the end of the object to enhance the user's enjoyment of the toy.

Next, in the portable agility enhancement apparatus prior art in United States Patent Application Publication Number 2013/0190145 to Kugielsky, disclosed is a dynamic weight training apparatus for improved calorie burning and muscle toning. The weight training apparatus in Kugielsky generally includes a pendulum mass suspended, e.g., via a flexible shaft, from a single handle or other securing mechanism. A user in Kugielsky swings the weight in a pendulum motion when exercising (walking, jogging, stationary, sitting or standing) providing for increased resistance. A flexible shaft in Kugielsky may advantageously dampen/reduce shock and strain associated with the pendulum motion.

What is needed is an agility enhancing apparatus that has a random unpredictability to the frequency and amplitude of the tethered changable weight movement that is created from the variability of the user's hands motion, plus movement of the user's torso and legs which in turn impart the variable frequency, amplitude, and load to a movement of the tethered weight, thus in turn creating the desirable "muscle confusion".

SUMMARY OF INVENTION

Broadly, the present invention is an agility enhancement apparatus for an individual to engage in manual agility enhancement activity, the agility enhancement apparatus includes a beam having a proximal end portion and an opposing distal end portion with a longitudinal axis spanning therebetween, further included in the agility enhancement apparatus is a weight affixed to the distal end portion, wherein the weight makes the distal end portion weigh more than the proximal end portion.

Also included in the agility enhancement apparatus is a flexible tether extension having a first end portion and an opposing second end portion with a longwise axis spanning therebetween, the flexible tether extension first end portion is affixed to the proximal end portion wherein the flexible tether second end portion is a free cantilever end, wherein operationally the individual grasps the tether second end portion and swings the beam in a free movement pattern.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
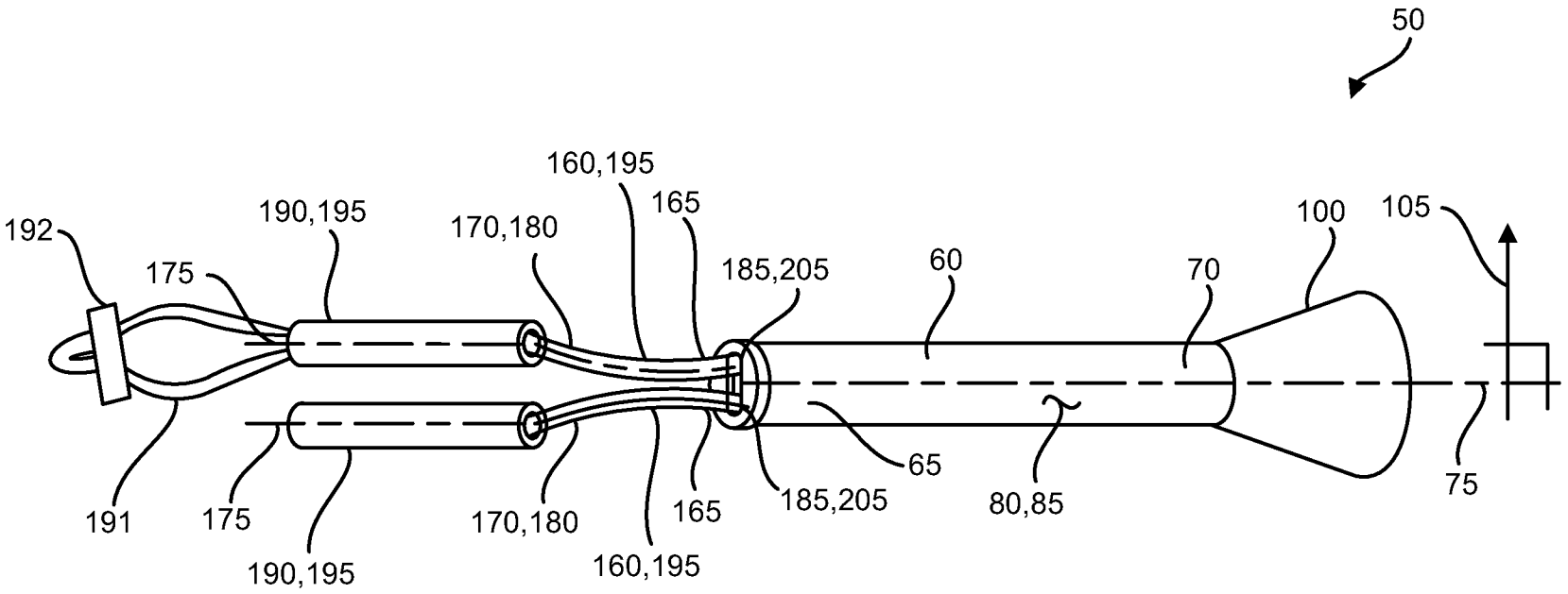
FIG. 1 shows a side elevation view of the agility enhancement apparatus that includes a beam having a proximal end portion and an opposing distal end portion with a longitudinal axis spanning therebetween, also shown is a distal end portion margin, plus a flexible tether extension with a first and second end portion having a longwise axis spanning therebetween with a handle affixed to the second end portion, wherein the handle includes a wrist strap and a cinch lock on the wrist strap.

50 Agility enhancement Apparatus
55 Individual user
60 Beam
65 Proximal end portion of the beam 60
70 Distal end portion of the beam 60
75 Longitudinal axis of the beam 60
80 Surrounding sidewall of the beam 60
85 Outer surface of the surrounding sidewall 80
90 Inner surface of the surrounding sidewall 80
95 Interior of the surrounding sidewall 80 of the beam 60
100 Margin of the distal end portion 70
105 Expanding outward of the margin 100 perpendicular to the longitudinal axis 75
110 Surface
115 Beam free standing on the surface 110
120 Perpendicular position of the longitudinal axis 75 to the surface 110
125 Weight
126 Weight receiving cavity for the spring clip 253
127 Axial frictional slidable engagement between the cavity 126 and the spring clip 253 along the longitudinal axis 75
130 Weight structurally affixed to the distal end portion 70 of the beam 60
135 Plurality of weights 125
140 Removably engagable plurality of weights 135 to the distal end portion 70
145 Plurality of weights 135 constructed of axially stacked discs
150 Plurality of weights constructed of axially stacked discs 145 that are interconnected to hold their relative position to one another
155 Plurality of weights 135 disposed within the interior 95
160 Flexible tether extension
165 First end portion of the flexible tether extension 160
170 Second end portion of the flexible tether extension 160
175 Longwise axis of the flexible tether extension 160
180 Free cantilever end of the second end portion 170
185 Flexible tether first end portion 165 affixed to the proximal end portion 65
190 Handle of the flexible tether 160 disposed on the second end portion 170
191 Safety wrist strap affixed to the second end portion 170
192 Cinch lock to tighten the safety wrist strap 191
195 Pair of flexile tether extensions
200 Flexible tether first end portion 165 disposed within the beam 60 interior 95
205 Flexible tether first end portion 165 affixed adjacent to the proximal end portion 65 within the beam 60 interior 95
210 Hands of the individual user 55
215 Grasping the tether 160 second end portion 170
220 Individual user 55 swings the beam 60 through hand 210 movement
225 Free movement pattern of the beam 60 as the individual user 55 swings 220 the beam 60
230 First repetitive movement pattern of individual user 55 hand 210 movement 220
235 Second repetitive movement pattern of the beam 60 from the first repetitive movement pattern 230
240 Individual moving each hand 210 in a different repetitive movement pattern
250 Plug for weight 125 retention with the beam 60 distal end portion 70
251 Protrusion of the plug 250 or weight 125
252 Annular channel of the protrusion 251
253 Spring clip partially circumferentially disposed within the channel 252
255 Means for removable engagement of plug 250 to the beam 60 distal end portion 70

260 Threadable engagement of the plug 250 to the beam 60 distal end portion 70

261 Threadable engagement of an outside diameter of the plug 250 to the beam 60 distal end portion 70

262 Threadable engagement of the plug 250 to the beam 60 distal end portion 70 via a threaded rod

265 Aperture guide and retainer for the flexible retainer extension 160 in the beam 60 proximal end portion 65 interior 95

270 Aperture of the aperture guide and retainer 265

275 Channel partial relief between apertures 270

280 Means for removable engagement of the aperture guide 265 to the beam 60 proximal end portion 65 interior 95

285 Threadable engagement of the aperture guide and retainer 265 to the beam 60 proximal end portion 65 interior 95

290 Compression bracket for the tether 160

295 Fastener for the compression bracket 290 to the aperture guide and retainer 265

DETAILED DESCRIPTION

With initial reference to FIG. 1 shown is a side elevation view of the agility enhancement apparatus 50 that includes a beam 60 having a proximal end portion 65 and an opposing distal end portion 70 with a longitudinal axis 75 spanning therebetween, also shown is a distal end portion 70 margin 100, plus a flexible tether extension 160 with a first 165 and a second 170 end portion having a longwise axis 175 spanning therebetween with a handle 190 affixed to the second end portion 170, wherein the handle 190 includes a wrist strap 191 and a cinch 192 lock on the wrist strap 191.

Figure 2:
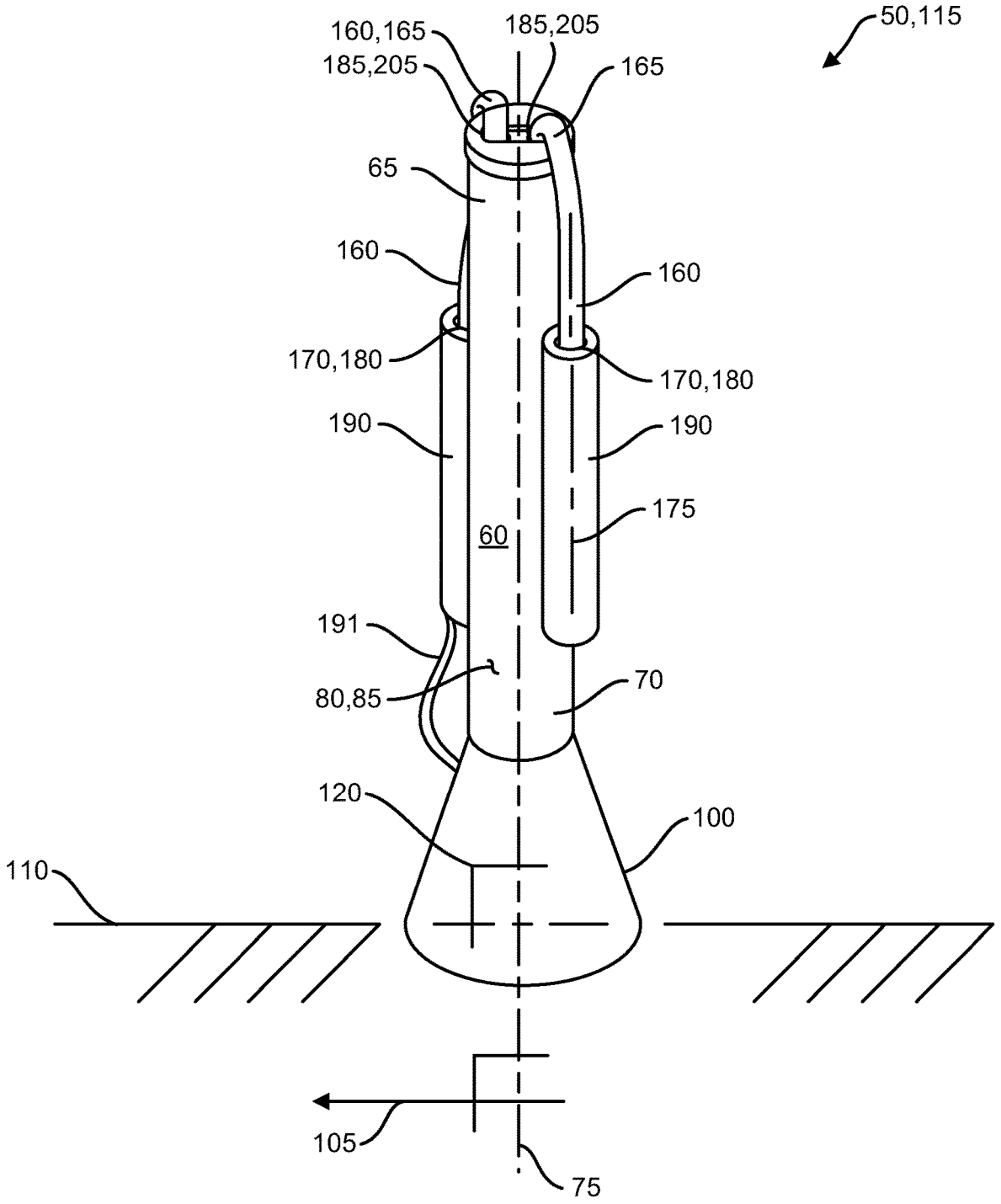
FIG. 2 shows an upper perspective view of the agility enhancement apparatus that includes a beam having a proximal end portion and an opposing distal end portion with a longitudinal axis spanning therebetween, also shown is a distal end portion margin, plus a flexible tether extension with a first and second end portion having a longwise axis spanning therebetween with a handle affixed to the second end portion, wherein the handle includes the wrist strap, further a resting surface is shown that the beam distal end portion margin is resting upon that results in the longitudinal axis being positioned perpendicular to the surface that conveniently allows the agility enhancement apparatus to be free standing on the surface as shown in FIG. 2.
Figure 3:
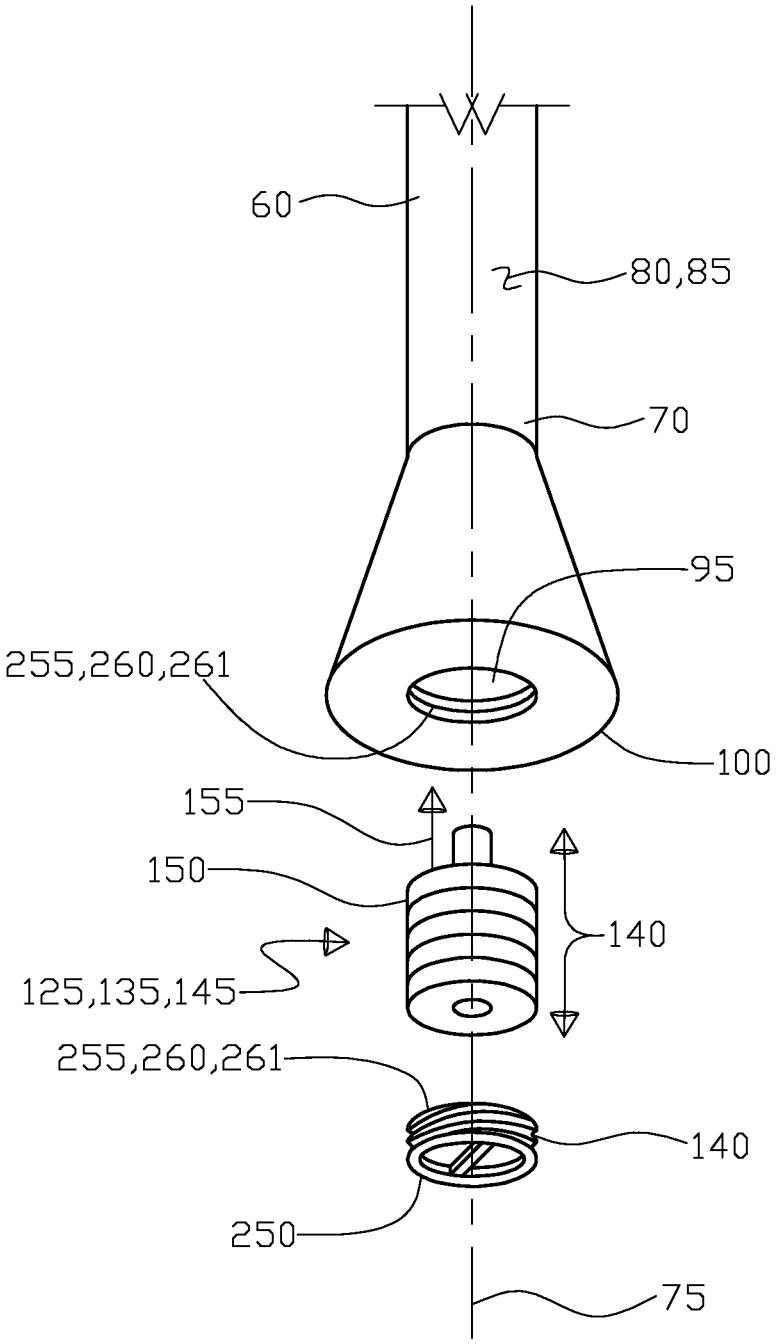
FIG. 3 shows an exploded diagram of the distal end portion of the beam showing in particular the expanding outward of the margin in relation to the longitudinal axis wherein an interior of the surrounding sidewall is shown, the interior receives a weight shown as a removably engagable plurality of weights that are disposed within the interior and the plurality of removably engagable weights are retained within the interior with a plug that itself has a means for removable engagement to the beam distal end portion that is shown in this view as a threadable engagement of the plug to the beam distal end portion.

Continuing, FIG. 2 shows an upper perspective view of the agility enhancement apparatus 50 that includes the beam 60 having the proximal end portion 65 and the opposing distal end portion 70 with the longitudinal axis 75 spanning therebetween. Also shown in FIG. 2 is the distal end portion 70 margin 100, plus the flexible tether extension 160 with a first 165 and second 170 end portion having the longwise axis 175 spanning therebetween with the handle 190 affixed to the second end portion 170, wherein the handle 190 includes the wrist strap 191, further a resting surface 110 is shown that the beam 60 distal end portion 70 margin 100 is resting upon that results in the longitudinal axis 75, being positioned perpendicular 120 to the surface 110 that conveniently allows the agility enhancement apparatus 50 to be free standing 115 on the surface 110 as shown in FIG. 2;

Next, FIG. 3 shows an exploded diagram of the distal end portion 70 of the beam 60 showing in particular the expanding outward 105 of the margin 100 in relation to the longitudinal axis 75, wherein the interior 95 of the surrounding sidewall 80 is shown, the interior 95 receives the weight 125 shown as the removably engagable plurality of weights 135 that are disposed 155 within the interior 95 and the plurality of removably engagable weights 140 are retained within the interior 95 with the plug 250 that itself has a means 255 for removable engagement to the beam 60 distal end portion 70. This is shown in FIG. 3 as a threadable engagement 260 of the plug 250 to the beam 60 distal end portion 70, via an outer diameter of the plug 250 being threadably engaged 261 to the distal end portion 70.

Figure 4:
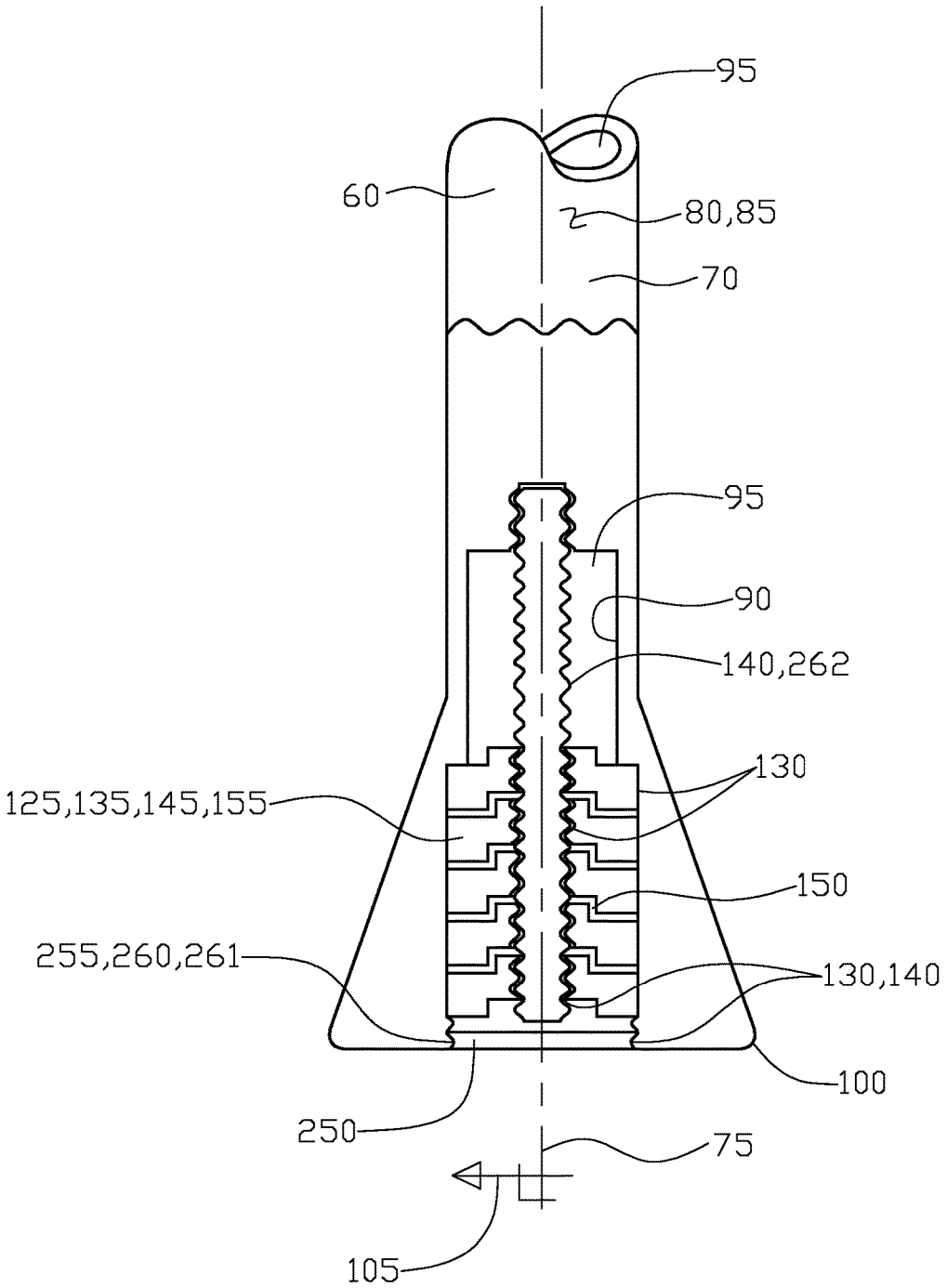
FIG. 4 shows a cross sectional view of FIG. 3, such that FIG. 4 shows the distal end portion of the beam showing in particular the expanding outward of the margin in relation to the longitudinal axis wherein the interior of the surrounding sidewall is shown, the interior receives a weight shown as a removably engagable plurality of weights that are a plurality of axially stacked discs that are interconnected to one another and disposed as a group within the interior and the plurality of removably engagable weights are retained within the interior with a plug that itself has a means for removable engagement to the beam distal end portion that is optionally shown as a threaded rod from the plug to the distal end portion.

Further continuing, FIG. 4 shows a cross sectional view of FIG. 3, such that FIG. 4 shows the distal end portion 70 of the beam 60 showing in particular the expanding outward 105 of the margin 100 in relation to the longitudinal axis 75 wherein the interior 95 of the surrounding sidewall 80 is shown. Also, FIG. 4 shows the interior 95 that receives the weight 125 being shown as a removably engagable 140 plurality of weights 135 that are further shown as a plurality of axially stacked discs 145 that are interconnected 150 to one another and disposed as a group within the interior 95 with the plurality of removably engagable weights 140 being retained within the interior 95 with the plug 250 that itself has the means 255 for removable engagement to the beam 60 distal end portion 70, that is optionally shown as a threaded rod 262 from the plug 250 to the distal end portion 70.

Figure 5:
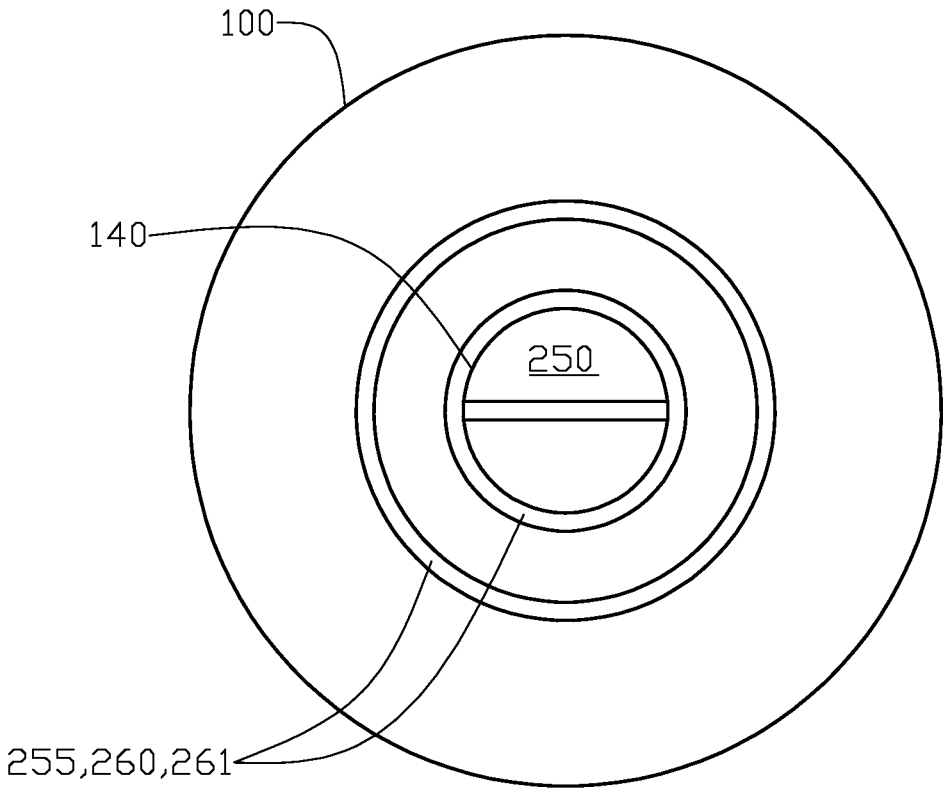
FIG. 5 shows a bottom end view of the beam of the agility enhancement apparatus showing in particular the plug, the means for removable engagement of the plug to the beam distal end portion in the form of a thread on the plug to the beam distal end portion, also shown is the margin on the beam distal end portion.

Continuing, FIG. 5 shows a bottom end view of the beam 60 of the agility enhancement apparatus 50 showing in particular the plug 250, the means 255 for removable engagement of the plug 250 to the beam 60 distal end portion 70 in the form of a thread 261 on the plug 250 to the beam 60 distal end portion 70, also shown is the margin 100 on the beam 60 distal end portion 70.

Figure 6:
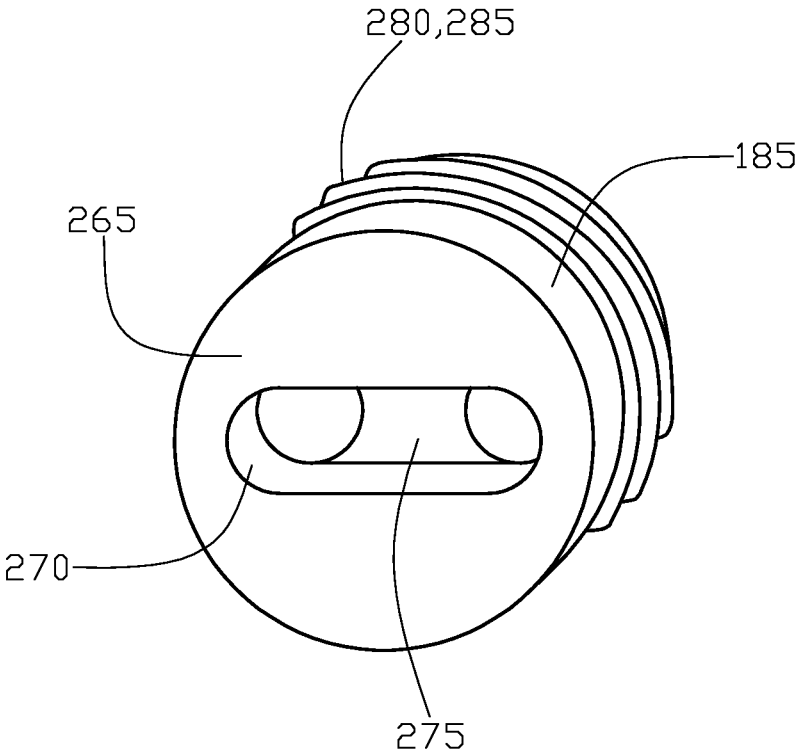
FIG. 6 shows a perspective view of an aperture guide and retainer that also shows an aperture and an aperture channel disposed between the apertures, further a means for removable engagement of the aperture guide and retainer to the beam proximal end portion in the form of a threadable engagement.

Moving onward, FIG. 6 shows a perspective view of an aperture guide and retainer 265 that also shows the aperture 270 and the aperture channel 275 disposed between the apertures 270, further the means 280 for removable engagement of the aperture guide and retainer 265 to the beam 60 proximal end portion 65 in the form of a threadable engagement 285.

Figure 7:
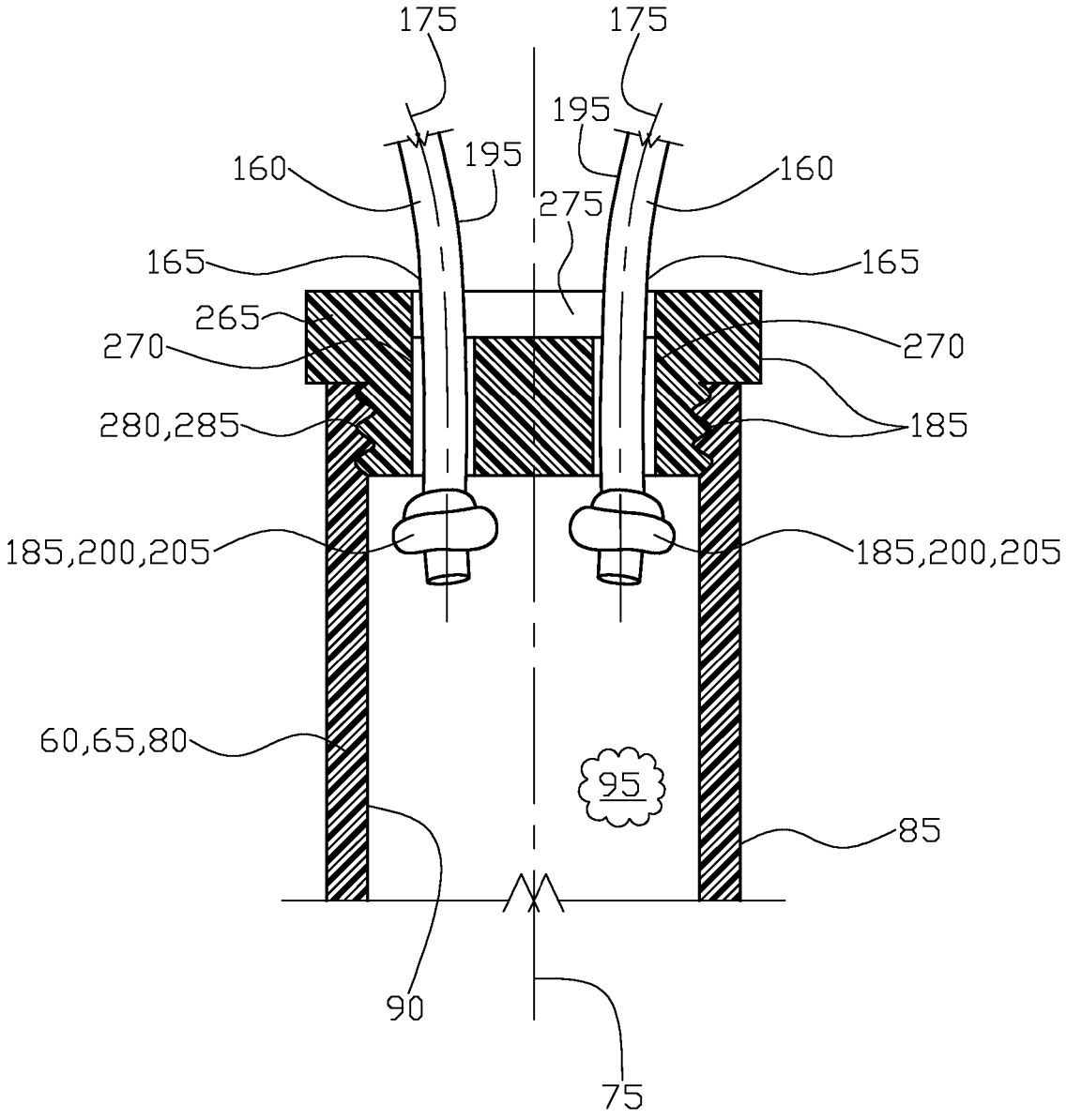
FIG. 7 shows a cross sectional view of the beam proximal end portion that shows the interior, the surrounding sidewall, the inner and outer surface of the sidewall, also with the aperture guide and retainer that also shows a pair of apertures and the aperture channel disposed between the pair of apertures, further the means for removable engagement of the aperture guide and retainer to the beam proximal end portion in the form of the threadable engagement, further shown is a pair of flexible tether extensions, that are one each disposed therethrough each of a pair of apertures and each have a flexible tether affixed to the beam proximal end portion within the interior.

Next, FIG. 7 shows a cross sectional view of the beam 60 proximal end portion 65 that shows the interior 95, the surrounding sidewall 80, the inner 90 and outer 85 surface of the sidewall 80, also with the aperture guide and retainer 265 that also shows a pair of apertures 270 and the aperture channel 275 disposed between the pair of apertures 270. Further FIG. 7 shows the means 280 for removable engagement of the aperture guide and retainer 265 to the beam 60 proximal end portion 65 in the form of the threadable engagement 285. Also shown in FIG. 7 is the pair of flexible tether extensions 160, that are one each disposed therethrough each of a pair of apertures 270 and each have a flexible tether 160 affixed 205 to the beam 60 proximal end portion 65 within 200 the interior 95.

Figure 8:
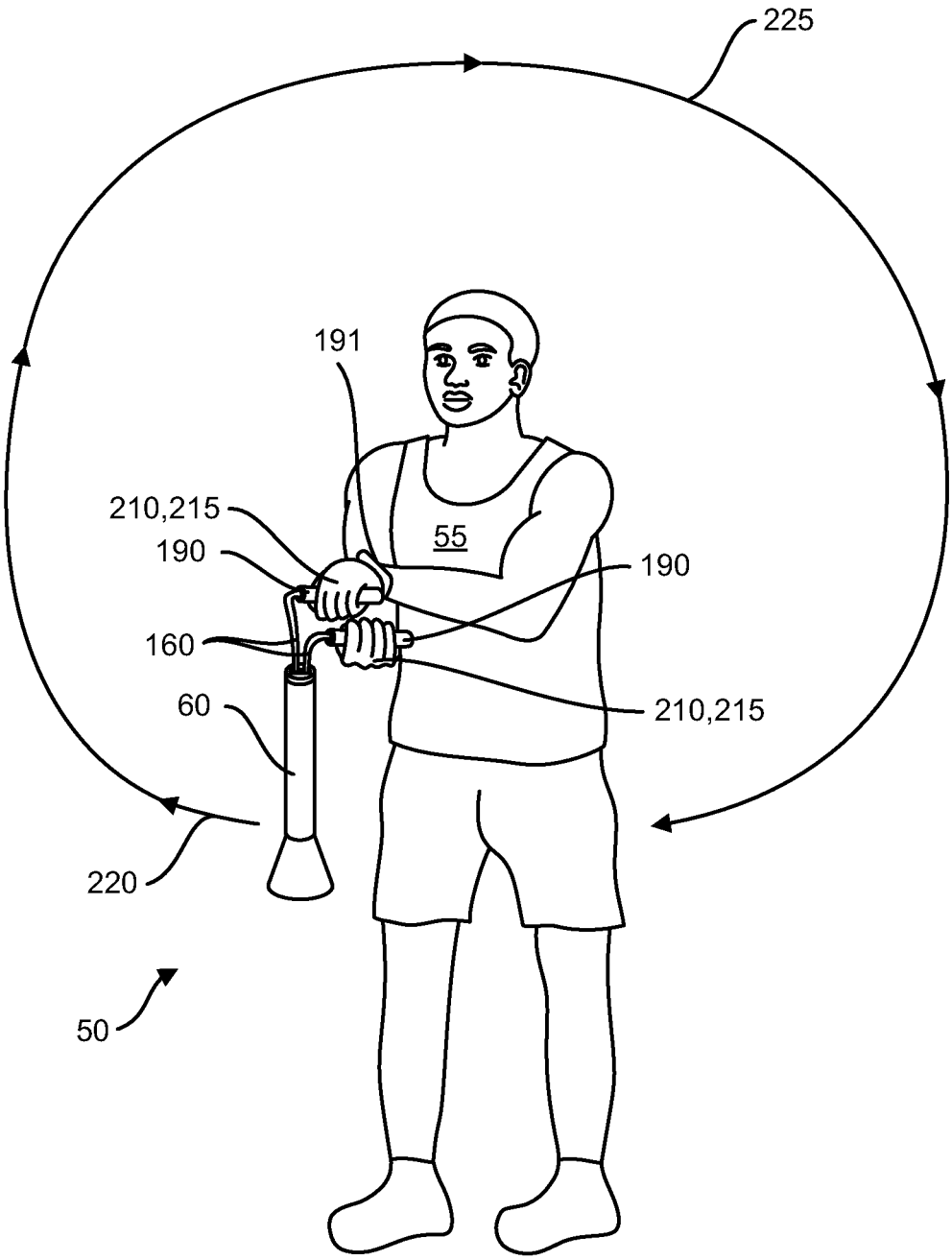
FIG. 8 shows a use view of the agility enhancement apparatus with an individual user using their hands to grasp the tether second end portion of the agility enhancement apparatus, wherein the individual user then swings the beam through their hand movement in a free movement pattern as shown, wherein the amount of weight can be selectively adjusted to change the intensity of the workout, note the wrist strap looped around the user's hand.

Yet, further FIG. 8 shows a use view of the agility enhancement apparatus 50 with the individual user 55 using their hands 210 to grasp 215 the tether 160 second end portion 170 of the agility enhancement apparatus 50, wherein the individual user 55 then swings 220 the beam 60 through their hand 210 movement in a free movement pattern 225 as shown, wherein the amount of weight 125 can be selectively adjusted to change the intensity of the workout, note the wrist strap 191 looped around the user's 55 hand 210.

Figure 9:
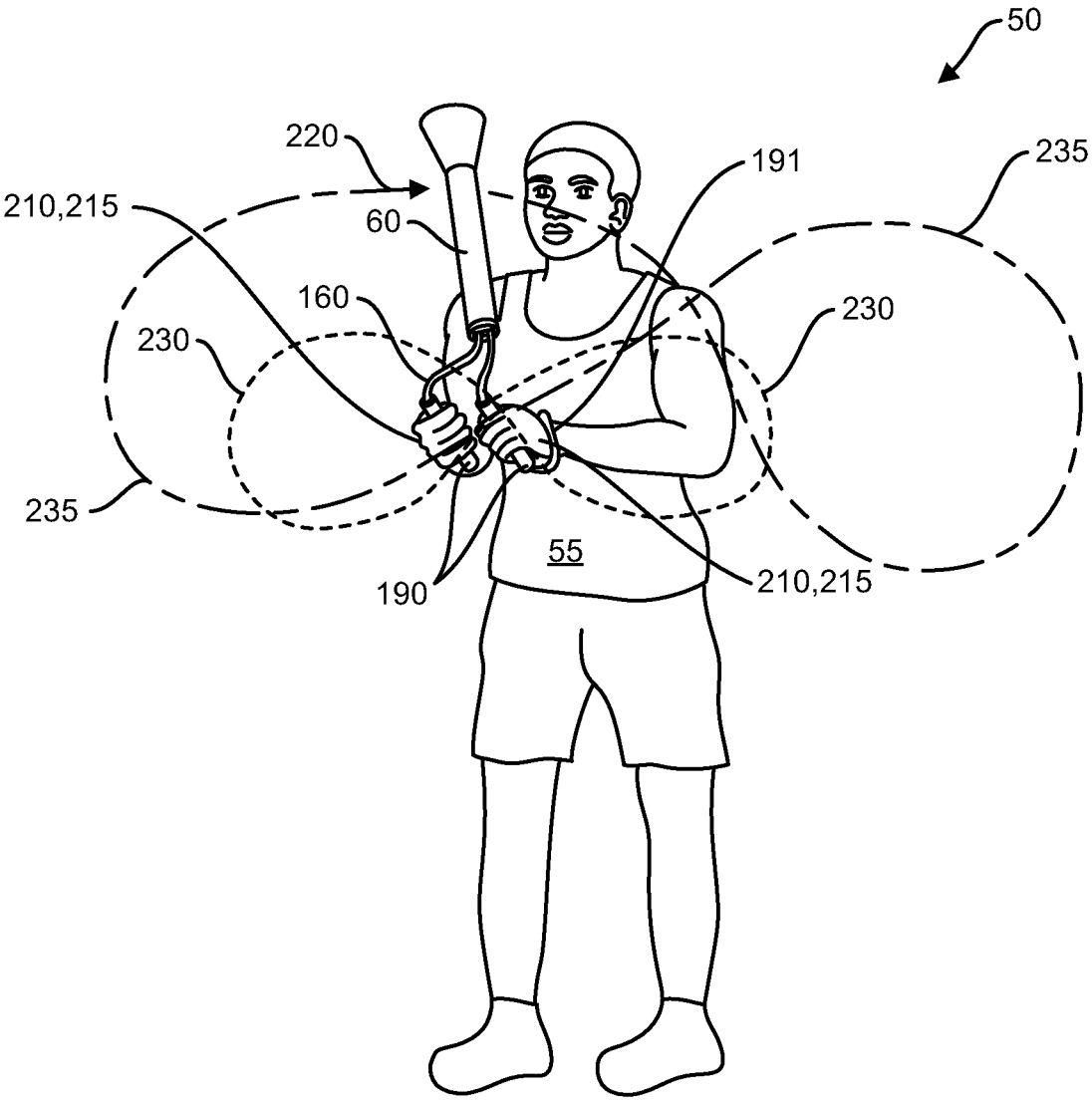
FIG. 9 shows the use view of the agility enhancement apparatus with the individual user using their hands to grasp the tether second end portion of the agility enhancement apparatus, wherein the individual user then swings the beam through their hand movement in a second repetitive movement pattern as shown for enhanced agility training and wherein the amount of weight can be selectively adjusted to change the intensity of the workout, note the wrist strap looped around the user's hand.

Next, FIG. 9 shows the use view of the agility enhancement apparatus 50 with the individual user 55 using their hands 210 to grasp 215 the tether 160 second end portion 170 of the agility enhancement apparatus 50, wherein the individual user 55 then swings 220 the beam through their hand 210 movement in a first 230 and/or second 235 repetitive movement pattern as shown for enhanced agility training and wherein the amount of weight 125 can be selectively adjusted to change the intensity of the workout, again note the wrist strap 191 looped around the user's 55 hand 210.

Figure 10:
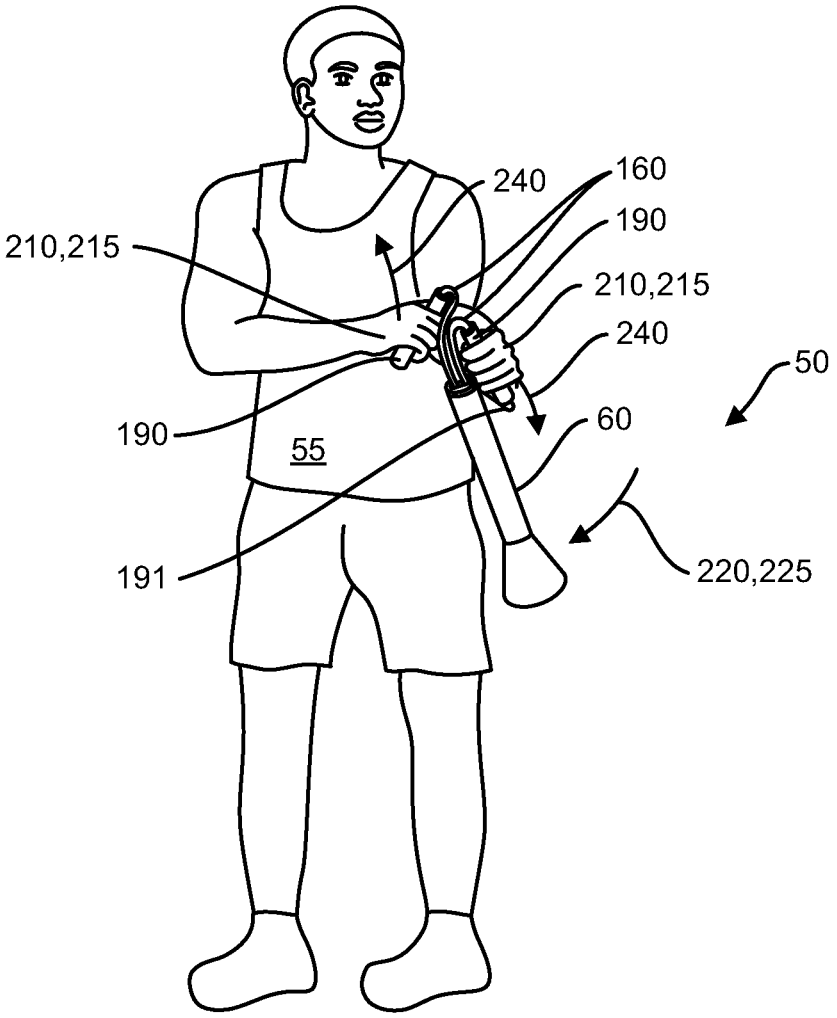
FIG. 10 shows the use view of the agility enhancement apparatus with the individual user using their hands to grasp the tether second end portion of the agility enhancement apparatus, wherein the individual user then swings the beam through independent, different, and separate hand movement for each hand in a beam swing movement as shown for enhanced agility training and wherein the amount of weight can be selectively adjusted to change the intensity of the workout, further the wrist strap is shown.

Continuing, FIG. 10 shows the use view of the agility enhancement apparatus 50 with the individual user 55 using their hands 210 to grasp 215 the tether 160 second end portion 170 of the agility enhancement apparatus 50, wherein the individual user 55 then swings 220 the beam 60 through independent, different, and separate hand movement 240 for each hand 210 in a beam swing movement 220, 225 as shown for enhanced agility training and wherein the amount of weight 125 can be selectively adjusted to change the intensity of the workout for the individual 55, further again the wrist strap 191 is shown.

Figure 11:
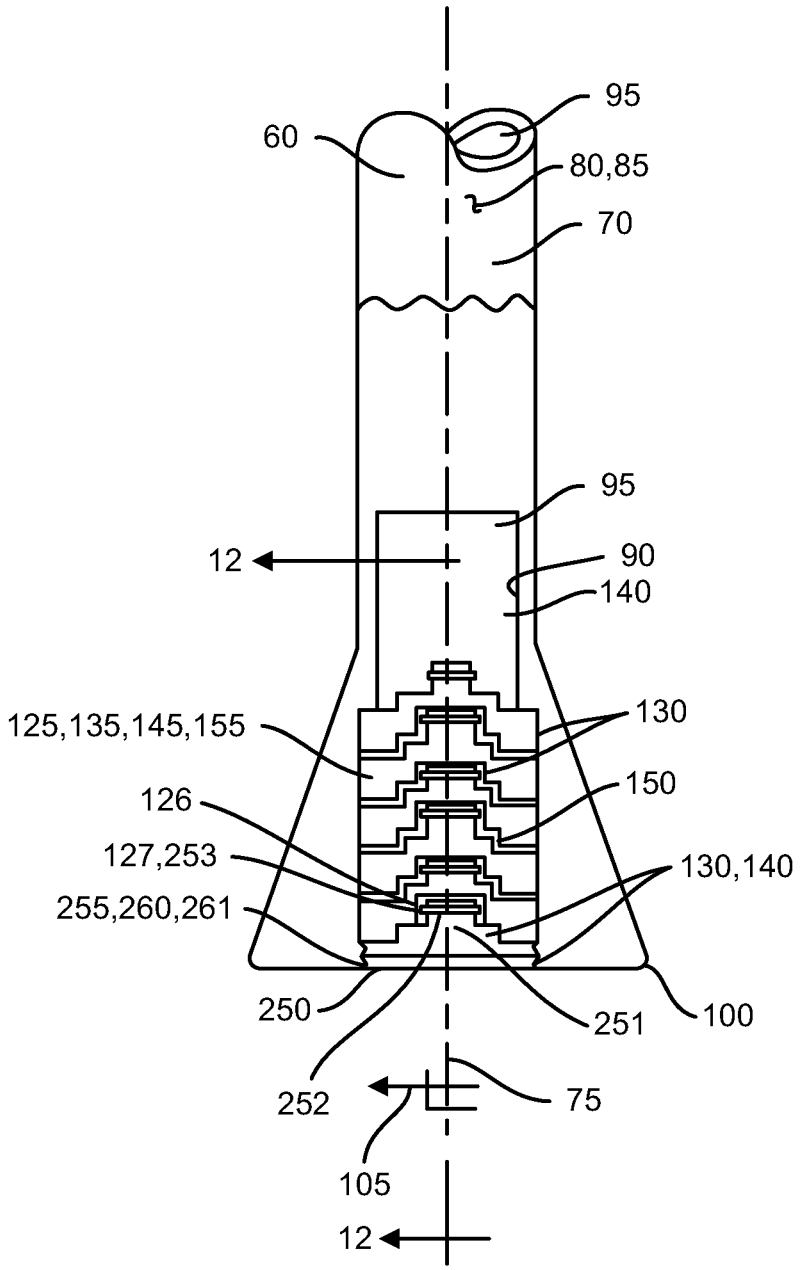
FIG. 11 shows an alternative cross sectional view of FIG. 3, such that FIG. 11 shows the distal end portion of the beam showing in particular the expanding outward of the margin in relation to the longitudinal axis wherein the interior of the surrounding sidewall is shown, the interior receives a weight shown as a removably engagable plurality of weights that are a plurality of axially stacked discs that are frictionally piloted and interconnected to one another via a spring clip on each disc protrusion, wherein a protrusion slidably engages a receiving cavity for each set of discs, wherein a plurality of discs are disposed as a group within the interior resulting in having the plurality of removably engagable weights that are retained within the interior with a plug that itself has a means for removable engagement to the beam distal end portion that is optionally shown as a threadable engagement from the plug to the distal end portion.

Next, FIG. 11 shows an alternative cross sectional view of FIG. 3, such that FIG. 11 shows the distal end portion 70 of the beam 60 showing in particular the expanding outward 105 of the margin 100 in relation to the longitudinal axis 75 wherein the interior 95 of the surrounding sidewall 80 is shown, the interior 95 receives a weight 125 shown as a removably engagable plurality of weights 135 that are a plurality of axially stacked discs 145 that are frictionally piloted 127 and interconnected to one another via a spring clip 253 on each disc 145. Further shown in FIG. 11 is a protrusion 251 that slidably engages a receiving cavity 126 for each set of discs 145, wherein the plurality of discs 145 are disposed as a group within the interior 95 resulting in having the plurality of removably engagable weights 145 that are retained within the interior 95 with a plug 250 that itself has a means 255 for removable engagement to the beam 60 distal end portion 70 that is optionally shown as a threadable engagement 260, 261 from the plug 250 to the distal end portion 70.

Figure 12:
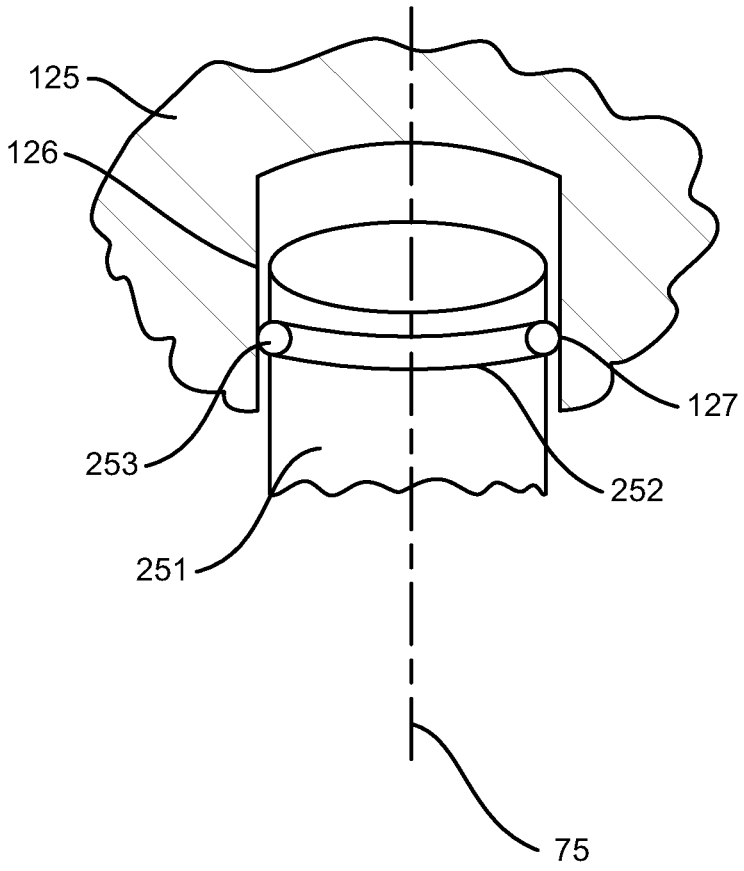
FIG. 12 is cross section 12-12 from FIG. 11 showing in detail the axial friction pilot and retention spring clip interface with the protrusion and receiving cavity interface wherein the spring clip is disposed within an annular channel that ultimately removably engages the plurality of weights to one another thus allowing variability in the number of weights that are fitted together to use the agility enhancement apparatus.

Yet further FIG. 12 is cross section 12-12 from FIG. 11 showing in detail the axial friction pilot 127 and retention spring clip 253 interface with the protrusion 251 and receiving cavity 126 interface 127 wherein the spring clip 253 is disposed within an annular channel 252 that ultimately removably engages the plurality of weights 135 to one another thus allowing variability in the number of weights 135 that are fitted together to use the agility enhancement apparatus 50.

Figure 13:
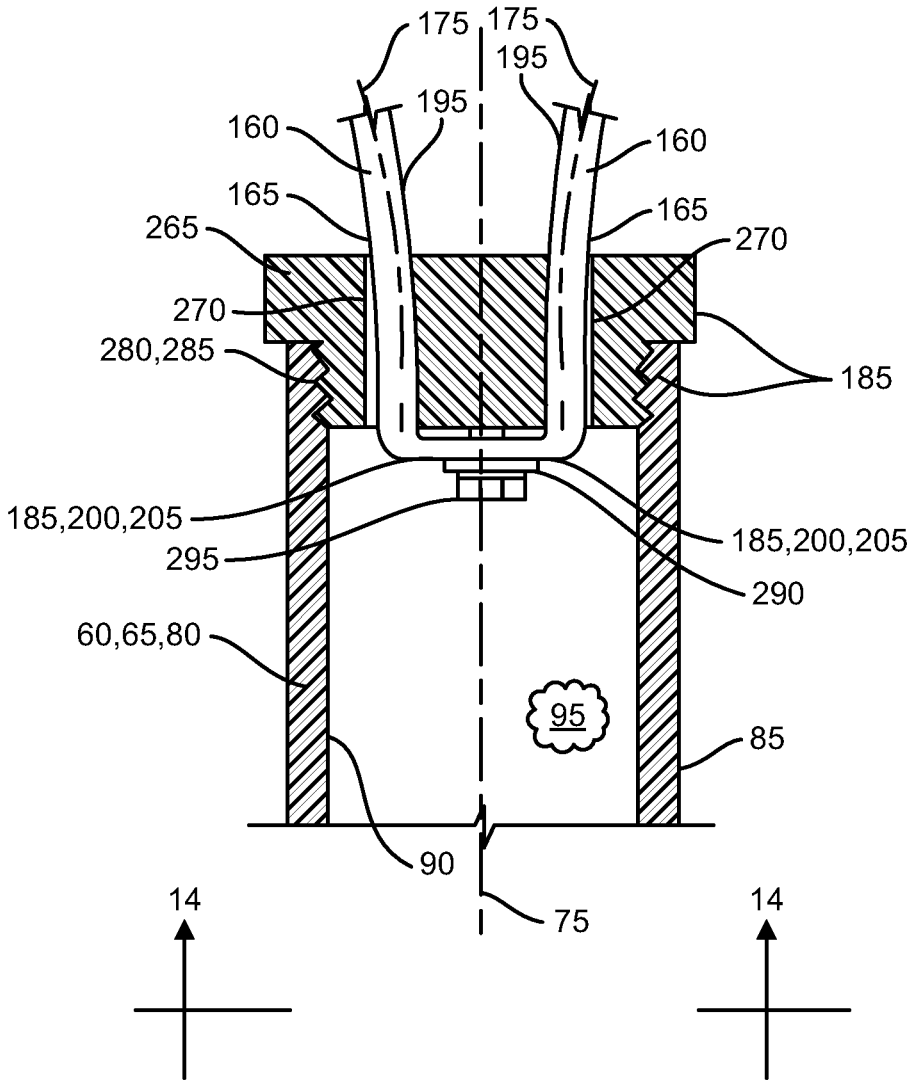
FIG. 13 shows an alternative cross sectional view of the beam proximal end portion that shows the interior, the surrounding sidewall, the inner and outer surface of the sidewall, also with the aperture guide and retainer that also shows a pair of apertures, further the means for removable engagement of the aperture guide and retainer to the beam proximal end portion in the form of the threadable engagement, further shown is a pair of flexible tether extensions, that are one each disposed therethrough each of a pair of apertures wherein the tether extensions are joined and clamped to the aperture guide and retainer via a compression bracket and fasteners within the interior.

Continuing, FIG. 13 shows an alternative cross sectional view of the beam 60 proximal end portion 65 that shows the interior 95, the surrounding sidewall 80, the inner 90 and outer 85 surface of the sidewall 80, also with the aperture guide and retainer 265 that also shows a pair of apertures 270, further the means 280 for removable engagement of the aperture guide and retainer 265 to the beam 60 proximal end portion 65 in the form of the threadable engagement 285. Further shown in FIG. 13 is a pair 195 of flexible tether extensions 160, that are one each disposed therethrough each of a pair of apertures 270 wherein the tether extensions 160 are joined and clamped to the aperture guide and retainer 265 via a compression bracket 290 and fasteners 295 within the interior 95.

Figure 14:
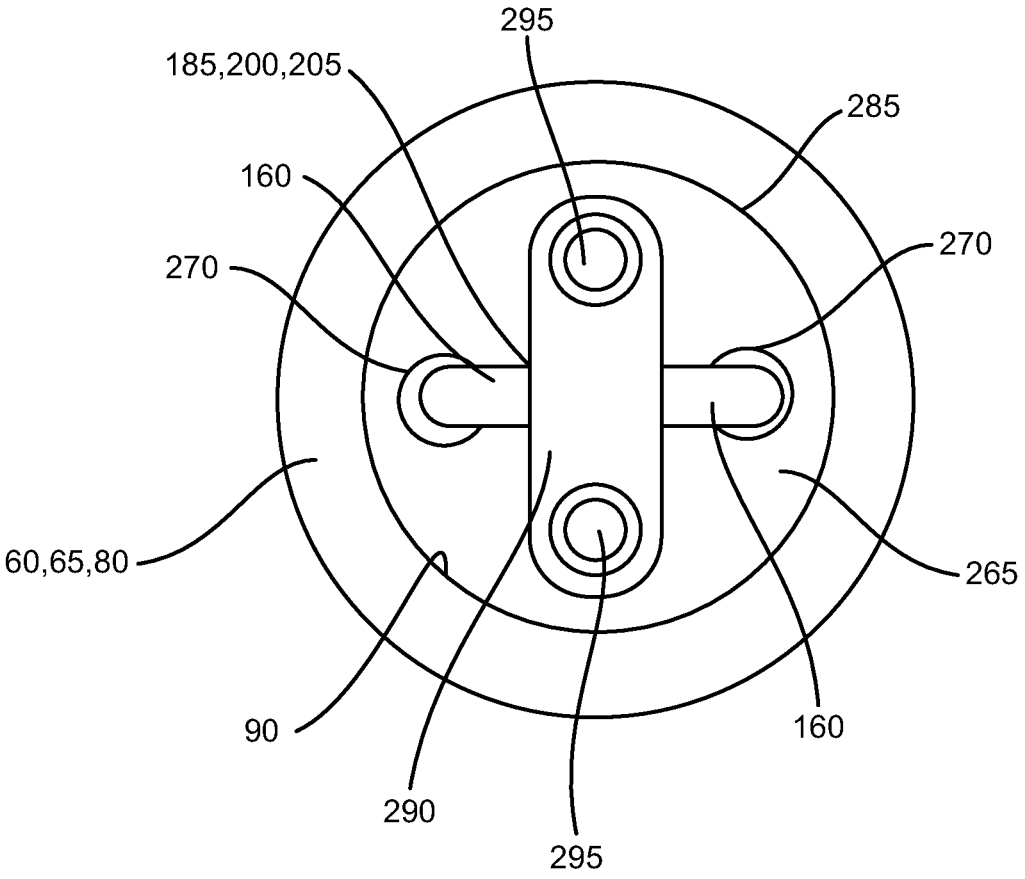
FIG. 14 shows view 14-14 from FIG. 13 that details the alternative cross sectional view of the beam proximal end portion that shows the interior, the surrounding sidewall, the inner and outer surface of the sidewall, also with the aperture guide and retainer that also shows a pair of apertures, further the means for removable engagement of the aperture guide and retainer to the beam proximal end portion in the form of the threadable engagement, further shown is a pair of flexible tether extensions, that are one each disposed therethrough each of a pair of apertures wherein the tether extensions are joined and clamped to the aperture guide and retainer via the compression bracket and the fasteners within the interior.

Next, FIG. 14 shows view 14-14 from FIG. 13 that details the alternative cross sectional view of the beam 60 proximal end portion 65 that shows the interior 95, the surrounding sidewall 80, the inner 90 and outer 85 surface of the sidewall 80, also with the aperture guide and retainer 265 that also shows a pair of apertures 270, further the means 280 for removable engagement of the aperture guide and retainer 265 to the beam 60 proximal end portion 65 in the form of the threadable engagement 285. Further shown is a pair 195 of flexible tether extensions 160, that are one each disposed therethrough each of a pair of apertures 270 wherein the tether extensions 160 are joined and clamped to the aperture guide and retainer 265 via the compression bracket 290 and the fasteners 295 within the interior 95.

Broadly, the present invention is the agility enhancement apparatus 50 for the individual 55 to engage in manual agility enhancement activity, the agility enhancement apparatus 50 including the beam 60 having the proximal end portion 65 and the opposing distal end portion 70 with the longitudinal axis 75 spanning therebetween, further included in the agility enhancement apparatus 50 is the weight 125 affixed to the distal end portion 70, wherein the weight 125 makes the distal end portion 70 weigh more than the proximal end portion 65, see in particular FIGS. 1, 2, 3, and 4, plus FIGS. 11 and 12.

Also included in the agility enhancement apparatus 50 is the flexible tether extension 160 having the first end portion 165 and the opposing second end portion 170 with the longwise axis 175 spanning therebetween, the flexible tether extension 160 first 165 end portion is affixed 185 to the proximal end portion 65 wherein the flexible tether 160 second end portion 170 is a free cantilever end 180, as best shown in FIGS. 1, 2, and 7, plus FIGS. 13 and 14. Wherein operationally, the individual 55 grasps 215 the tether 160 second end portion 170 and swings 220 the beam 60 in a free movement pattern 225, as shown in FIG. 8.

As an option for the agility enhancement apparatus 50, can further comprise a plurality of weights 135 that are each removably engagable 140 to the distal end portion 70 to operationally facilitate a selectable amount of weight 125 to be added to the distal end portion 70, as best shown in FIGS. 3, 4, and 5. Further to weight 125 options, the plurality of weights 135 can be constructed of a plurality of axial stacked discs 150 along the longitudinal axis 75, see FIGS. 3 and 4, plus FIGS. 11 and 12.

A further option for the agility enhancement apparatus 50, is wherein the distal end portion 70 can terminate in the margin 100 that expands outward 105 in a direction perpendicular to the longitudinal axis 75 to operationally facilitate the beam 60 to be able to be free standing 115 on the surface 110 wherein the longitudinal axis 75 is perpendicular 120 to the surface 110, see in particular FIG. 2.

As an alternative for the agility enhancement apparatus 50, it can further comprise a handle 190 that is disposed upon the flexible tether extension 160 second end portion 170, see FIGS. 1 and 2. Additional options for the flexible tether extension 160 on the agility enhancement apparatus 50, that is can further comprise a pair 195 of flexible tether extensions 160, each having the first end portion 165 and the opposing second end portion 170 with each having the longwise axis 175 spanning therebetween, wherein the pair 195 of flexible tether extension 160 first end portions 165 are affixed 185 to the beam 60 proximal end portion 65 and the pair 195 of flexible tether extension 160 second end portions 170 are independently separate and are each a free cantilever end 180, as best shown in FIGS. 1, 2, 7, 13, and 14. Another option on the flexible tether extension 160 for the agility enhancement apparatus 50, is wherein each flexible tether extension 160 second end portion 170 can further comprise a handle 190 disposed upon each flexible tether extension 160 second end portion 170, see in particular FIGS. 1 and 2.

Continuing for options on the agility enhancement apparatus 50, the beam 60 can further be constructed in the form of a surrounding sidewall 80 having the proximal end portion 65 and the opposing distal end portion 70 with the longitudinal axis 75 spanning therebetween, wherein the surrounding sidewall 80 can have an outer surface 85 and an opposing inner surface 90, wherein the proximal end portion 65, the inner surface 90, and the distal end portion 70 all act to define a beam interior 95, see FIGS. 3, 4, 7, 13, and 14 in particular.

Further, optionally on the agility enhancement apparatus 50, the weight 125 can disposed within the interior 95 being structurally affixed 130 adjacent to the distal end portion 70, wherein the weight 125 makes the distal end portion 70 weigh more than the proximal end portion 65, see FIGS. 3 and 4, plus FIGS. 11 and 12.

Another option of the flexible tether extension 160 that has the first end portion 165 and the opposing second end portion 170 with the longwise axis 175 spanning therebetween, the flexible tether extension 160 first end portion 165 can be disposed within the interior 95 and affixed 185 adjacent to the proximal end portion 65 wherein the flexible tether 160 second end portion 170 is a free cantilever end 180, wherein operationally the individual 55 grasps 215 the tether 160 second end portion 170 and swings 220 the beam 60 in a free movement pattern 225, see FIGS. 7, 8, 13, and 14.

A further option for the agility enhancement apparatus 50 can further comprise a plurality of weights 135 that are each disposed 155 within the interior 95 and removably engagable 140 to the distal end portion 70, to operationally facilitate a selectable amount of weight to be added to the distal end portion 70, see FIGS. 3 and 4, plus FIGS. 11 and 12. As a further option on the agility enhancement apparatus 50, the plurality of weights 135 can be constructed of a plurality of axial stacked discs 145 along the longitudinal axis 75 being disposed within the interior 95, again see FIGS. 3 and 4, plus FIGS. 11 and 12.

Yet another option for the agility enhancement apparatus 50, can further comprise the pair 195 of flexible tether extensions 160 each having the first end portion 165 and the opposing second end portion 170 with each having the longwise axis 175 spanning therebetween, wherein the pair 195 of flexible tether extension 160 first end portions 165 are disposed 200 within the interior 95 and affixed 205 adjacent to the beam 60 proximal end portion 65 and the pair 195 of flexible tether extension 160 second end portions 170 are independently separate and are each a free cantilever end 180, see FIGS. 7, 13, and 14 in particular and also FIGS. 1 and 2.

Method of Use

Referring primarily to FIGS. 8, 9, and 10 for the use of the agility enhancement apparatus 50 by the individual 55, a method of using the agility enhancement apparatus 50 includes the steps of firstly providing the agility enhancement apparatus 50 that includes the beam 60 in the form of a surrounding sidewall 80 having the proximal end portion 65 and the opposing distal end portion 70 with the longitudinal axis 75 spanning therebetween, wherein the surrounding sidewall 80 can have an outer surface 85 and an opposing inner surface 90, wherein the proximal end portion 65, the inner surface 90, and the distal end portion 70 all act to define a beam interior 95, see FIGS. 3, 4, and 7, in particular. Further, the agility enhancement apparatus 50, includes the weight 125 disposed within the interior 95 being structurally affixed 130 adjacent to the distal end portion 70, wherein the weight 125 makes the distal end portion 70 weigh more than the proximal end portion 65, see FIGS. 3 and 4. In addition, included in the agility enhancement apparatus 50 is the pair 195 of flexible tether extensions 160 that have the first end portion 165 and the opposing second end portion 170 with the longwise axis 175 spanning therebetween, each flexible tether extension 160 first end portion 165 can be disposed within the interior 95 and affixed 185 adjacent to the proximal end portion 65 wherein the flexible tether 160 second end portion 170 is a free cantilever end 180, see FIGS. 1, 2, and 7.

Next, secondly a step of grasping 215 by an individual 55, the pair of flexible tether 160 second end portions 170 having one in each hand 210 of the individual 55, also see FIGS. 1 and 2. Thirdly a step of moving by the individual 55 their hands 215 in a first repetitive pattern 230 causing the beam 60 to swing in a pendulum like manner in a second repetitive pattern 235 to effectuate a repetitive strength and agility coordination agility enhancement for the individual 55, as best shown in FIG. 9.

Optionally for the method of using an agility enhancement apparatus 50, the third moving step is modified by the individual 55 moving each hand 210 in a different repetitive pattern 240 to help increase the strength and agility demands upon the individual 55, as best shown in FIG. 10.

Another option for the method of using the agility enhancement apparatus 50, wherein the first providing step weight can further comprise a plurality of weights 135 that are each disposed within the interior 95 and are each removably engagable to the distal end portion 70, to operationally facilitate an added step of having a selectable amount of weight 125 to be added or removed from the distal end portion 70 to increase or decrease the intensity of the strength and agility demands upon the individual 55, see in particular FIGS. 3, 4, and 5.

As an option for the agility enhancement apparatus 50 in looking at FIGS. 11 and 12 in particular, the plurality of axial stacked weight discs 135 can each have an interfacing removably engagable interlock 145, 150 that is constructed of a protrusion 251 that is received by a cavity 126, wherein the protrusion 251 further includes an annular channel 252 that has a spring clip 253 disposed therein, wherein the spring clip 253 axially slidably frictionally engages 127 the cavity 126 via movement along the longitudinal axis 75.

As another option for the agility enhancement apparatus 50 in looking at FIGS. 1, 2, 8, 9, and 10, the handle 190 can further comprise a wrist safety strap 191 to operationally keep the handle 190 in the user's 55 possession should the user let go of the handle 190 with their hand 210, further an optional cinch lock 192 can be added to the wrist safety strap 191 to tighten the safety wrist strap 191 to the user's 55 hand 210.

As a further option for the agility enhancement apparatus 50 on looking at FIGS. 13 and 14 in particular wherein the affixed 185 first end portions 165 are constructed of a compression bracket 290 and a fastener 295 that is attached to the beam proximal end portion 65 that act to compress the first end portions 165 to the beam proximal end portion 65.

CONCLUSION

Accordingly, the present invention of an agility enhancement apparatus has been described with some degree of particularity directed to the embodiments of the present invention. It should be appreciated, though; that the present invention is defined by the following claims construed in light of the prior art so modifications and changes may be made to the exemplary embodiments of the present invention without departing from the inventive concepts contained therein.

The invention claimed is:

1. An agility enhancement apparatus for an individual to engage in manual agility enhancement activity, said agility enhancement apparatus comprising:

(a) a beam having a proximal end portion and an opposing distal end portion with a longitudinal axis spanning therebetween, said distal end portion terminates in a margin that expands outward in a direction perpendicular to said longitudinal axis to operationally facilitate said beam free standing on a surface wherein said longitudinal axis is perpendicular to the surface;

(b) a weight affixed to said distal end portion, wherein said weight makes said distal end portion weigh more than said proximal end portion;

(c) a flexible tether extension having a first end portion and an opposing second end portion with a longwise axis spanning therebetween, said flexible tether extension first end portion is affixed to said proximal end portion wherein said flexible tether extension second end portion is a free cantilever end, wherein operationally the individual grasps said flexible tether extension second end portion and swings said beam in a free movement pattern.

2. The agility enhancement apparatus according to claim 1 further comprising a plurality of weights that are each removably engagable to said distal end portion to operationally facilitate a selectable amount of weight to be added to said distal end portion.

3. The agility enhancement apparatus according to claim 2 wherein said plurality of weights are constructed of a plurality of axially stacked discs along said longitudinal axis.

4. The agility enhancement apparatus according to claim 1 further comprising a handle disposed upon said flexible tether extension second end portion.

5. The agility enhancement apparatus according to claim 1 further comprising a pair of flexible tether extensions each having a first end portion and an opposing second end portion with each having said longwise axis spanning therebetween, wherein said pair of flexible tether extension first end portions are affixed to said beam proximal end portion and said pair of flexible tether extension second end portions are independently separate and are each a free cantilever end.

6. The agility enhancement apparatus according to claim 5 wherein each said flexible tether extension second end portion further comprises a handle disposed upon each said flexible tether extension second end portion.

7. An agility enhancement apparatus for an individual to engage in manual agility enhancement activity, said agility enhancement apparatus comprising:

(a) a beam in the form of a surrounding sidewall having a proximal end portion and an opposing distal end portion with a longitudinal axis spanning therebetween, wherein said surrounding sidewall having an outer surface and an opposing inner surface, wherein said proximal end portion, said inner surface, and said distal end portion all act to define a beam interior, said distal end portion terminates in a margin that expands outward on said outer surface in a direction perpendicular to said longitudinal axis to operationally facilitate said beam free standing on a surface wherein said longitudinal axis is perpendicular to the surface;

(b) a weight disposed within said beam interior being structurally affixed adjacent to said distal end portion, wherein said weight makes said distal end portion weigh more than said proximal end portion;

(c) a flexible tether extension having a first end portion and an opposing second end portion with a longwise axis spanning therebetween, said flexible tether extension first end portion is disposed within said beam interior and affixed adjacent to said proximal end portion wherein said flexible tether extension second end portion is a free cantilever end, wherein operationally the individual grasps said tether second end portion and swings said beam in a free movement pattern.

8. The agility enhancement apparatus according to claim 7 further comprising a plurality of weights that are each disposed within said beam interior and removably engagable to said distal end portion, to operationally facilitate a selectable amount of weight to be added to said distal end portion.

9. The agility enhancement apparatus according to claim 8 wherein said plurality of weights are constructed of a plurality of axially stacked discs along said longitudinal axis.

10. The agility enhancement apparatus according to claim 9 wherein said plurality of axially stacked discs each have an interfacing removably engagable interlock that is constructed of a protrusion that is received by a cavity, wherein said protrusion further includes an annular channel that has a spring clip disposed therein, wherein said spring clip axially slidably frictionally engages said cavity via movement along said longitudinal axis.

11. The agility enhancement apparatus according to claim 7 further comprising a handle disposed upon said flexible tether extension second end portion.

12. The agility enhancement apparatus according to claim 11 wherein said handle further comprises a wrist safety strap to operationally keep the handle in possession of the individual should the individual let go of the handle with a hand of the individual.

13. The agility enhancement apparatus according to claim 7 further comprising a pair of flexible tether extensions each having a first end portion and an opposing second end portion with each having said longwise axis spanning therebetween, wherein said pair of flexible tether extension first end portions are disposed within said beam interior and affixed adjacent to said beam proximal end portion and said pair of flexible tether extension second end portions are independently separate and are each a free cantilever end.

14. The agility enhancement apparatus according to claim 13 wherein said affixed first end portions are respectively constructed of a compression bracket and a fastener that is attached to said beam proximal end portion that act to respectively compress said first end portions to said beam proximal end portion.

15. The agility enhancement apparatus according to claim 13 wherein each said flexible tether extension second end portion further comprises a handle disposed upon each said flexible tether extension second end portion.

* * * * *